United States Patent [19]

Dugan

[11] 4,326,928

[45] Apr. 27, 1982

[54] METHOD OF ELECTROFORMING

[75] Inventor: William P. Dugan, Pomona, Calif.

[73] Assignee: General Dynamics, Pomona Division, Pomona, Calif.

[21] Appl. No.: 228,430

[22] Filed: Jan. 26, 1981

[51] Int. Cl.[3] ..... C25D 1/02

[52] U.S. Cl. ..... 204/9

[58] Field of Search ..... 204/9, 3, 4

[56] References Cited

U.S. PATENT DOCUMENTS

| | | | |
|---|---|---|---|
| 3,464,898 | 9/1969 | Norris | 204/9 |
| 3,763,030 | 10/1973 | Zimmer | 204/9 |
| 3,947,348 | 3/1976 | Schabernack | 204/9 |

FOREIGN PATENT DOCUMENTS

| | | | |
|---|---|---|---|
| 4499 | of 1885 | United Kingdom | 204/9 |

OTHER PUBLICATIONS

Electronics, Sep. 11, 1959, pp. 114–117.

*Primary Examiner*—T. M. Tufariello

*Attorney, Agent, or Firm*—Neil F. Martin; Earl F. Kotts; Edward B. Johnson

[57] ABSTRACT

A method of electroforming a part comprising the steps of electroless depositing a coat of metal on a mandrel of heat shrinkable material, electrodepositing a second coating of metal over the first coat, heating to a temperature which will shrink the mandrel, and removing the shrunken mandrel from the electroformed part.

2 Claims, 8 Drawing Figures

ELECTROLESS DEPOSITION

ELECTRODEPOSITION

METHOD OF ELECTROFORMING

BACKGROUND OF THE INVENTION

The invention relates to a method of electroforming finished parts utilizing a heat shrinkable mandrel.

Conventional approaches to the electroforming of parts are expensive and time consuming. One such method involves the use of mandrels which can be dissolved. An aluminum mandrel is used upon which a coating of metal is deposited. The mandrel is then placed in a sodium hydroxide bath to dissolve the mandrel. Another process utilizes a stainless steel mandrel which must be carefully machined with a taper so that it can be removed from the finished part. Stainless steel has the ability to accept a plated coating and can, with proper handling, be removed from the final electroplated parts.

The present invention avoids these difficulties with a simple, relatively low cost process, which leads itself to commercial usage.

SUMMARY OF THE INVENTION

It is an object of the invention to provide a new and improved process for electroforming parts which is simple in execution and relatively inexpensive to perform.

It is another object of the present invention to provide such a new and improved process for electroforming a part which will readily produce parts of complex configuration.

The process of the invention uses mandrel means of heat shrinkable material. An electroless coating of metal is deposited on the mandrel means for providing a base for a subsequent metal coating. A second coating of metal is electrodeposited on the first coating for providing a part of the desired thickness. The coated mandrel means is then subjected to heating and the mandrel means shrinks away from the part formed by the metal coatings. The mandrel means is then removed from the finished part to complete the process.

DETAILED DESCRIPTION OF THE DRAWINGS

Figure 1:
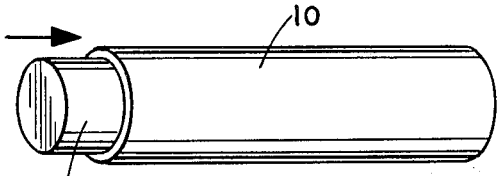
FIG. 1 of the drawings shows a first step of the process of the present invention wherein a plug is inserted inside a heat shrinkable mandrel to prevent the inside of the mandrel from being coated later in the process.

The drawings demonstrate the process of the present invention being used to form a copper tube. Electroforming is a desirable process for making a part because the thickness of a part can be carefully controlled and the electroforming process provides a smooth finish. It is to be understood that although a tubular part is demonstrated, parts of various configurations can be produced by the process of the present invention. A mandrel of heat shrinkable material is indicated at 10 in the drawings. Heat shrinkable materials are known in the art and a polyolefin such as polyethylene and polypropylene works well in the process of the present invention. The heat shrinkable material has the capacity to accept the metal coating and shrink away from the coating when sufficient heat is applied.

FIG. 1 of the drawings shows a plug 12 being inserted into the mandrel to prevent the internal surface of the tubular mandrel from being coated in a subsequent step of the process.

Figure 2:
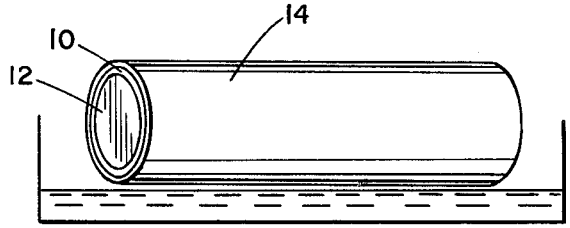
FIG. 2 demonstrates the step of applying an electroless base coating on the mandrel.

The mandrel 10 with the plug 12 inserted therein is then subjected to an electroless coating process as shown in FIG. 2 of the drawings. The drawings demonstrate the mandrel being immersed in a bath of electroless copper. It is to be understood that this base coating can be applied by other processes, such as spray coating a metal or painting the base metal coating with a metal paint. The purpose of the base coating is to provide a base for the subsequent electroplating process which electrodeposits a final coating of metal over the mandrel. The polyolefin which has been used provides a good base for electroless deposition. It was unnecessary to roughen the surface of the mandrel to obtain a satisfactory base coating.

Figure 3:
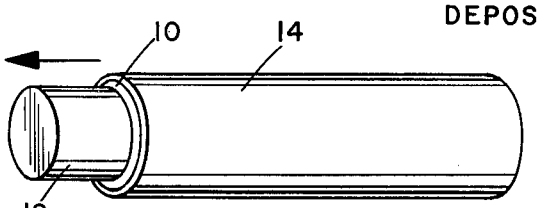
FIG. 3 shows the plug being removed from the mandrel which now has the base coating thereon.

Next, the plug 12 is removed from the mandrel 10 as shown in FIG. 3 of the drawings. The external surface of the mandrel 10 now has been plated with the base coating 14 which enables the mandrel to be coated by an electrodeposition process, such as electroplating. The internal surface of the mandrel 10 has no base coating because the plug 12 prevented the electroless coating from reaching the interior of the mandrel during the coating process.

Figure 4:
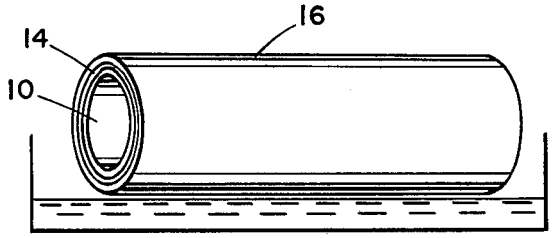
FIG. 4 illustrates the step of electroplating the external surface of the mandrel.
Figure 5:
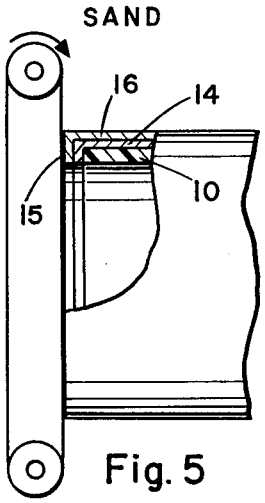
FIG. 5 shows the ends of the mandrel being sanded to facilitate withdrawal of the mandrel and removal of an unneeded portion of the coating.

The mandrel is next subjected to electroplating in a copper bath as shown in FIG. 4 of the drawings. The finished dimension of the tubular part is controlled by the plating bath concentration and current density as well known in the art. At this point in the process the part comprising the final coating 16 and the base coating 14 is disposed on the mandrel 10. In the example shown in the drawing with a tube being formed, it is desirable to remove the plated coatings from the end of the plated mandrel. This makes it easier for the mandrel to shrink from the electroformed part and eliminates the ledge formed over the ends of the finished part. FIG. 5 of the drawings demonstrates the ends of the mandrel being sanded to accomplish this purpose.

Figure 6:
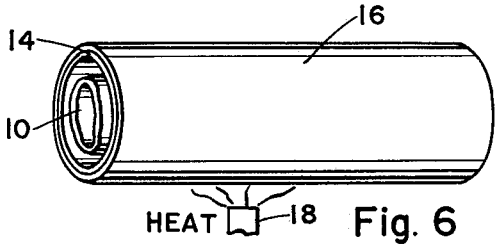
FIG. 6 demonstrates the step of heating the coated mandrel.
Figure 7:
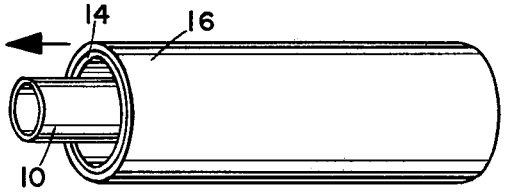
FIG. 7 shows the heat shrunken mandrel being removed from the final tubular part which has been formed by the coatings.

Next, the coated mandrel 10 is heated as demonstrated graphically by the heat source 18 in FIG. 6 of the drawings. When the temperature reaches the point desired for the particular heat shrinkable material involved, the mandrel 10 shrinks from its original dimension. These heat shrinkable materials change dimension drastically, and shrinkages on the order of 50% are common. The mandrel 10 shrinks away from the tubular part which now consists of the base coating 14 and final coating 16. Due to the reduction in size, the mandrel 10 is readily removed from the final part as demonstrated in FIG. 7 of the drawings. It has been found that mandrels of a hollow configuration afford better shrinking characteristics than solid mandrels.

Figure 8:
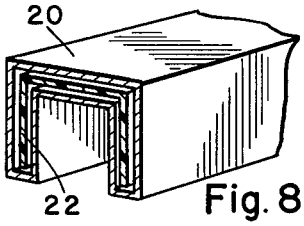
FIG. 8 is a view partly in section, demonstrating a part of complex configuration formed by the electroforming method of the present invention with the shrinkable mandrel about to be removed.

The process of the present invention is particularly adventageous when forming parts of complex configuration. The mandrel is shaped to the configuration of the part to be formed, and the only limitation is that a path be provided for removing the mandrel from the finished part. FIG. 8 of the drawings demonstrates a channel-shaped part 20 which has been formed by the process of the present invention with the shrunken mandrel 22 inside the finished part and ready to be removed from the end of the part. It will be recognized that circular shapes such as a tube extending in less than a 360 degree configuration can be formed in this manner. Also, a part having various complex shapes and configurations can be electrodeposited on a shrinkable mandrel as long as the mandrel has a path of withdrawal from the finished part.

While the present invention has been illustrated and described by means of a particular embodiment, it is to be understood that numerous changes and modifications may be made therein without departing from the spirit and scope of the invention as defined in the appended claims.

Having thus described my invention, I claim:

1. The method of electroforming a metallic part comprising the steps of:

depositing an electroless base coating of metal on a tubular plastic mandrel of heat shrinkable material such as polyethylene or polypropylene and having an integral solid wall;

electrodepositing a secondary coating of metal over said base coating to form a part;

mechanically removing a portion of the metal coatings off at least one extremity of the part to facilitate removal of the mandrel;

thereafter heating the coated mandrel to shrink the mandrel away from the part formed by the coating; and physically removing the mandrel from the finished part.

2. The method of electroforming a metallic part according to claim 1 wherein the mandrel is tubular and the inner surface of the mandrel is shielded during deposition of the base coating by inserting plug means into the ends of said tubular mandrel prior to depositing the base coating;

said plug means is thereafter removed from the ends of said mandrel prior to the step of electrodepositing the secondary coating; and the ends of said part are sanded to remove any overhang at the ends of said part.

* * * * *